US008941333B2

(12) United States Patent
Kim et al.

(10) Patent No.: US 8,941,333 B2
(45) Date of Patent: Jan. 27, 2015

(54) LIGHTING CONTROL METHOD AND DEVICE

(75) Inventors: Insu Kim, Seoul (KR); Tae-Gyu Kang, Daejeon (KR); Seong Hee Park, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 501 days.

(21) Appl. No.: 13/289,383

(22) Filed: Nov. 4, 2011

(65) Prior Publication Data

US 2012/0161642 A1 Jun. 28, 2012

(30) Foreign Application Priority Data

Dec. 23, 2010 (KR) ..... 10-2010-0133665

(51) Int. Cl.
*H05B 37/00* (2006.01)

(52) U.S. Cl.
USPC .... 315/316; 315/312; 315/209 R; 315/185 S; 315/291

(58) Field of Classification Search
USPC ..... 315/185 S, 209 R, 312–326, 291
See application file for complete search history.

(56) References Cited

U.S. PATENT DOCUMENTS 7,748,878 B2 * 7/2010 Lee ..... 362/386
2004/0027238 A1 * 2/2004 Magner et al. ..... 340/5.54

FOREIGN PATENT DOCUMENTS

KR 10-2009-0074596 A 7/2009

* cited by examiner

*Primary Examiner* — Tuyet Thi Vo

(57) ABSTRACT

A device for controlling an LED lighting in an LED lighting control system including a plurality of LED lightings which are connected via a network is provided. A lighting data receiver receives a first lighting control signal and extracts first lighting control data for the LED lighting from the first lighting control signal including a confirmation code. A verifier verifies the first lighting control data based on the confirmation code, and an error processor records error information when the verifier fails to verify the first lighting control data. A driving signal processor converts the first lighting control data to a driving signal when the verifier succeeds to verify the first lighting control data. An LED driver controls lighting of an LED light source based on the driving signal.

11 Claims, 8 Drawing Sheets

LIGHTING CONTROL METHOD AND DEVICE

CROSS-REFERENCE TO RELATED APPLICATION

This application claims priority to and the benefit of Korean Patent Application No. 10-2010-0133665 filed in the Korean Intellectual Property Office on Dec. 23, 2010, the entire contents of which are incorporated herein by reference.

BACKGROUND (a) Field

The present invention relates to a lighting control method and device. More particularly, the present invention relates to a method and device for controlling light emitting diode (LED) lighting.

(b) Description of the Related Art

As a lighting device widely uses LEDs, which are semiconductor elements that can transmit information using visible light, as light sources, technology for controlling the lighting device via a network has been developed. An existing lighting control protocol is used for transferring only data for basic lighting.

In the existing technology, only data are transferred without any control signal and a safety device that can guarantee integrity of data does not exist. Therefore, when a transmission error occurs, sudden light pollution such as flickering, black-out, and glare may be caused. Further, because a confirmation procedure of data does not exist, it is impossible to cope with an erroneous operation of a lighting system that may occur by wrong data of a malicious purpose.

According to an example of the related art, in a state where a console device for lighting control and a plurality of receiving devices are coupled in series, a system sequentially transmits DMX512 data packets from the console device to each receiving device in order that is connected adjacent to the console device. However, because an device that guarantees safety of a lighting control signal transferred via a communication line does not exist in this system, light pollution occurred by a natural or intentional control signal change cannot be prevented.

SUMMARY

Embodiments of the present invention provide a lighting control method and device for verifying a lighting control signal.

An embodiment of the present invention provides a device for controlling an LED lighting in an LED lighting control system including a plurality of LED lightings which are connected via a network. The device includes a lighting data receiver, a verifier, an error processor, a driving signal processor, and an LED driver. The lighting data receiver receives a first lighting control signal and extracts first lighting control data for the LED lighting from the first lighting control signal including a confirmation code. The verifier verifies the first lighting control data based on the confirmation code, and the error processor records error information when the verifier fails to verify the first lighting control data. The driving signal processor converts the first lighting control data to a driving signal when the verifier succeeds to verify the first lighting control data. The LED driver controls lighting of an LED light source based on the driving signal.

The error processor may compare the error information with previous error information to determine whether the same error is repeated, and determine reliability of a source of the first lighting control data when the same error is repeated.

The error processor may blink the LED light source with a first color in a first cycle when the source of the first lighting control data has reliability, and blink the LED light source with a second color different from the first color or in a second cycle different from the first cycle when the source of the first lighting control data does not have reliability.

The device may further include a lighting data transmitter configured to transmit a second lighting control signal to a next LED lighting among the plurality of LED lightings when the verifier succeeds to verify the first lighting control data.

The lighting data transmitter may generate a new confirmation code based on confirmation code information including the confirmation code and second lighting control data to be transferred to the next LED lighting, and generate the second lighting control signal by adding the new confirmation code to the second lighting control data.

The confirmation code information may further include an identifier and an installation code of the LED lighting. The lighting data transmitter may generate a first hash operation value by a hash operation of the confirmation code and the second lighting control data, generate a second hash operation value by a hash operation of the first hash operation value and the identifier, and generate the new confirmation code by a hash operation of the second hash operation value and the installation code.

The lighting data transmitter may add the new confirmation code to a last slot of a plurality of slots that are included in the second lighting control signal.

The lighting data receiver may receive the first lighting control signal from a previous LED lighting among the plurality of LED lightings.

The confirmation code may be generated by the previous LED lighting, and be generated based on information including the first lighting control data and a confirmation code which the previous LED lighting extracts from a received lighting control signal.

The lighting data receiver may receive the lighting control signal from a remote lighting control device that controls the plurality of LED lightings via the network.

The confirmation code may be generated by the remote lighting control device, and be generated based on information including the first lighting control data and a random number that is generated in the remote lighting control device.

Another embodiment of the present invention provides a method of controlling lighting in a remote lighting control device that controls a plurality of LED lightings which are connected via a network. The method includes generating a random number, generating a confirmation code based on confirmation code information including the random number and lighting control data to be transferred to a beginning LED lighting of the plurality of LED lightings, and transferring a lighting control signal including the confirmation code and the lighting control data to the beginning LED lighting.

The confirmation code information may include an identifier and an installation code of the remote lighting control device. Generating the confirmation code may include performing a hash operation of the random number and the lighting control data, and generating the confirmation code based on a calculation value of the hash operation, the identifier, and the installation code.

The method may further include adding the confirmation code to a last slot of a plurality of slots of the lighting control signal.

Yet another embodiment of the present invention provides a method of controlling lighting of an LED lighting in an LED lighting control system including a plurality of LED lightings which are connected via a network. The method includes receiving a first lighting control signal, extracting first lighting control data for the LED lighting from the first lighting control signal, extracting a confirmation code from the first lighting control data, generating a new confirmation code based on confirmation code information including the confirmation code and second lighting control data to be transferred to a next LED lighting of the plurality of LED lightings, and transferring a second lighting control signal including the new confirmation code and the second lighting control data to the next LED lighting.

The confirmation code information may further include an identifier and an installation code of the LED lighting, Generating the new confirmation code may include performing a hash operation of the confirmation code and the second lighting control data, and generating the new confirmation code based on a calculation value of the hash operation, the identifier, and the installation code.

The method may further include adding the new confirmation code to a last slot of a plurality of slots of the second lighting control signal.

The method may further include verifying the first lighting control data based on the confirmation code, converting the first lighting control data to a driving signal when verification of the first lighting control data is succeeded, and controlling lighting of an LED light source based on the driving signal.

The method may further include recording error information when verification of the first lighting control data is failed.

The method may further include comparing the error information with previous error information to determine whether the same error is repeated, determining reliability of a source of the first lighting control data when the same error is repeated, and controlling a blinking color or a blinking cycle of the LED light source according to the reliability of the source.

DETAILED DESCRIPTION OF THE EMBODIMENTS

Figure 1:
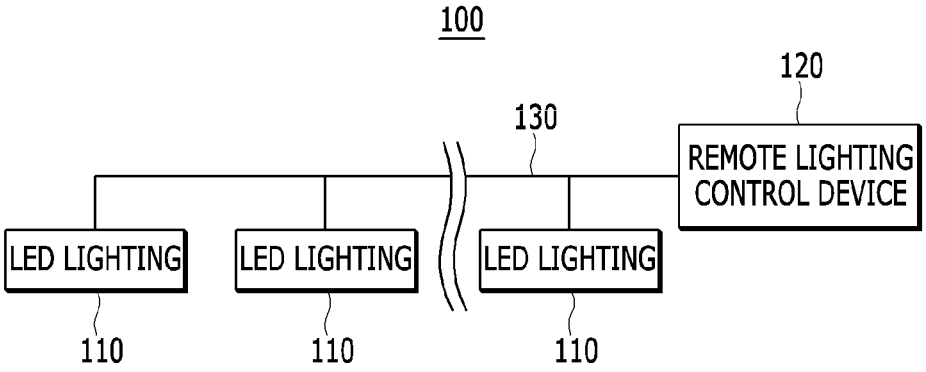
FIG. 1 is a diagram showing an LED lighting control system according to an embodiment of the present invention.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

FIG. 1 is a diagram showing an LED lighting control system according to an embodiment of the present invention.

Referring to FIG. 1, an LED lighting control system 100 includes a plurality of LED lightings 110, a remote lighting control device 120, and an LED lighting network 130 that connects them.

Each LED lighting 110 has an identifier (ID) for distinguishing from other LED lightings 110 and turns on a light source based on lighting control data that receive through the LED lighting network 130.

The remote lighting control device 120 transmits lighting control data to each LED lighting 110 and transmits a confirmation code for verifying an error of lighting control data when transmitting the lighting control data. The confirmation code is generated by the LED lighting 110 or the remote lighting control device 120 and is generated based on lighting control data that is actually transmitted. Therefore, it can be detected whether lighting control data are changed with the confirmation code. Further, because the confirmation code is verified and is newly generated whenever passing each LED lighting on the LED lighting network 130, an error of a specific interval can be detected by the confirmation code.

The LED lighting network 130 transfers lighting control data from the remote lighting control device 120 to each LED lighting device 110. The LED lighting network 130 may have a topology of a bus, a ring, a tree, or a star and has a bi-directional or one direction communication function.

Figure 2:
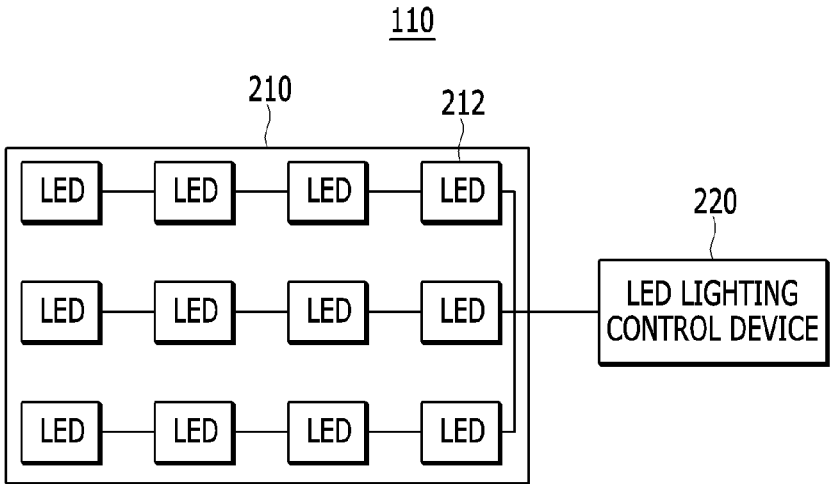
FIG. 2 is a diagram showing a structure of LED lighting of FIG. 1.

FIG. 2 is a diagram showing a structure of the LED lighting 110 of FIG. 1.

Referring to FIG. 2, the LED lighting 110 includes an LED module 210 and an LED lighting control device 220.

The LED module 210 includes a plurality of LED light sources 212 that can be controlled individually or collectively, and the LED lighting control device 220 turns on the LED module 210 with lighting control data received from the LED lighting network 130.

A plurality of LED light sources 212 may emit light of a single color or multi-colors, and multi-colors light is emitted by lighting control data including color data. The LED lighting control device 220 has a communication interface that can connected to the LED lighting network 130.

Figure 3:
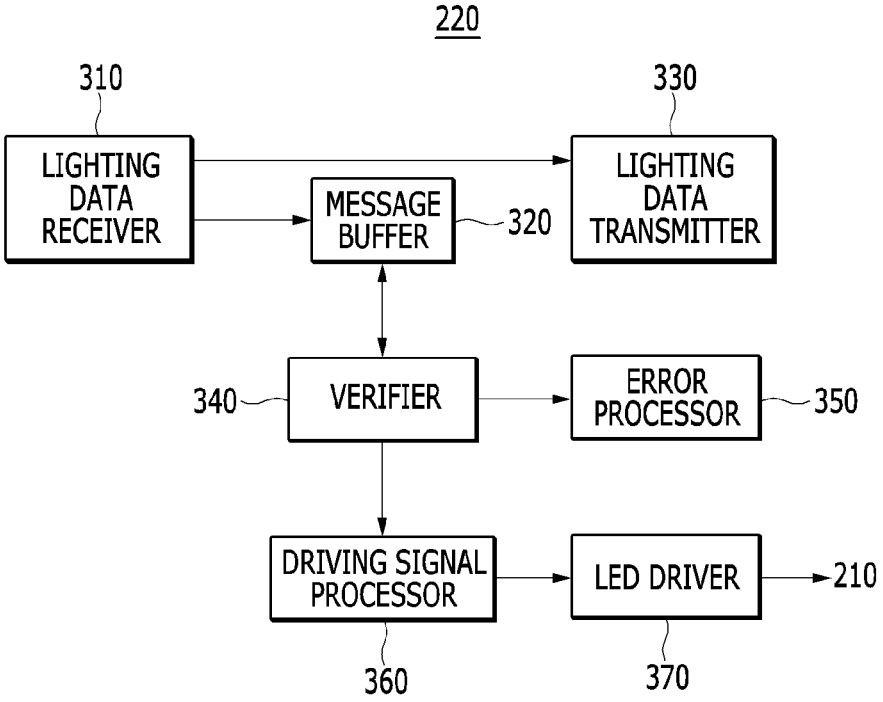
FIG. 3 is a block diagram showing an LED lighting control device of FIG. 2.

FIG. 3 is a block diagram showing the LED lighting control device of FIG. 2.

Referring to FIG. 3, the LED lighting control device 220 includes a lighting data receiver 310, a message buffer 320, a lighting data transmitter 330, a verifier 340, an error processor 350, a driving signal processor 360, and an LED driver 370.

The lighting data receiver 310 receives a lighting control signal from the LED lighting network 130, and transfers the lighting control signal to the lighting data transmitter 330. The lighting data receiver 310 extracts lighting control data from the lighting control signal, and transfers the lighting control data to the message buffer 320. In order to verify lighting control data, the message buffer 320 temporarily stores lighting control data. The lighting data transmitter 330 transmits the lighting control signal to the next LED lighting 110.

The verifier 340 verifies integrity of lighting control data based on a confirmation code. If lighting control data are safe lighting control data, the verifier 340 transfers the lighting control data to the driving signal processor 360. If lighting control data are wrong lighting control data, the verifier 340 transfers the lighting control data to the error processor 350. The error processor 350 records a source and a generating time of lighting control data in which verification is failed and detects a cause of a data error. The driving signal processor 360 converts the lighting control data to a driving signal such as pulse width modulation (PWM) and transfers the driving signal to the LED driver 370, and the LED driver 370 controls lighting of the LED light source 210 by controlling the LED light source 210.

Hereinafter, a method of controlling LED lighting of the LED lighting control device 220 will be described in detail with reference to FIG. 4.

Figure 4:
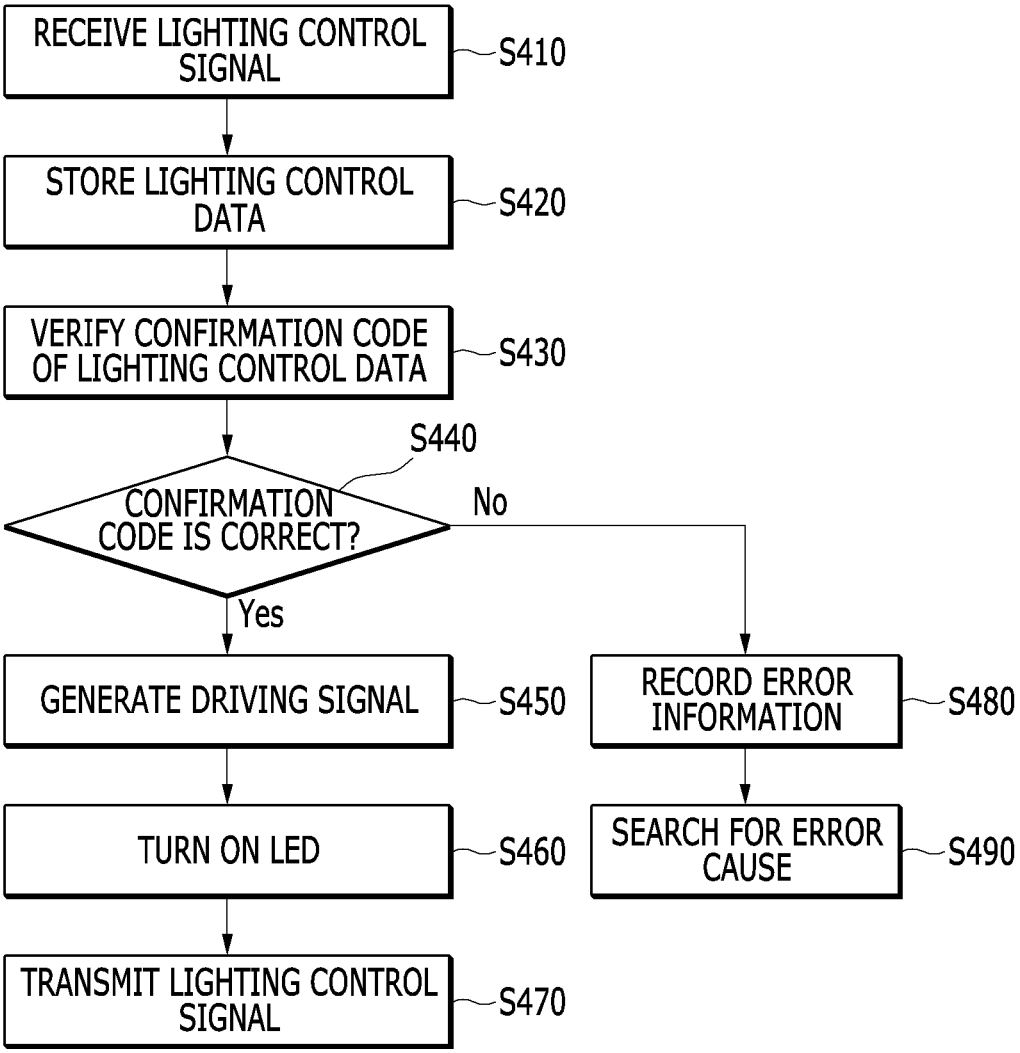
FIG. 4 is a flowchart showing a method of controlling LED lighting according to an embodiment of the present invention.

FIG. 4 is a flowchart showing a method of controlling LED lighting according to an embodiment of the present invention.

Referring to FIG. 4, the LED lighting control device 220 receives a lighting control signal from the LED lighting network 130 (S410). The lighting control signal is transferred from the previous LED lighting 110 or from the remote lighting control device 120 via the LED lighting network 130 when the previous LED lighting 110 does not exist. The LED lighting control device 220 extracts lighting control data from the lighting control signal and stores the lighting control data in the message buffer 320 (S420). The LED lighting control device 220 verifies that a confirmation code included in the lighting control data corresponds to lighting control data (S430). The LED lighting control device 220 determines whether the confirmation code is correct (S440). If the confirmation code is correct, the LED lighting control device 220 generates a driving signal (S450), turns on the LED light source 212 with the driving signal (S460), and transmits the lighting control signal to the next LED lighting 110 (S470). If the confirmation code is not correct at step S440, the LED lighting control device 220 records information of a lighting data source, an error generating time, and/or error contents. (S480), and searches for an error cause based on the recorded information (S490). In this case, a manager can perform an appropriate action in the LED lighting control system based on the error cause.

Next, a method of processing an error in the LED lighting control device 220 will be described in detail with reference to FIG. 5.

Figure 5:
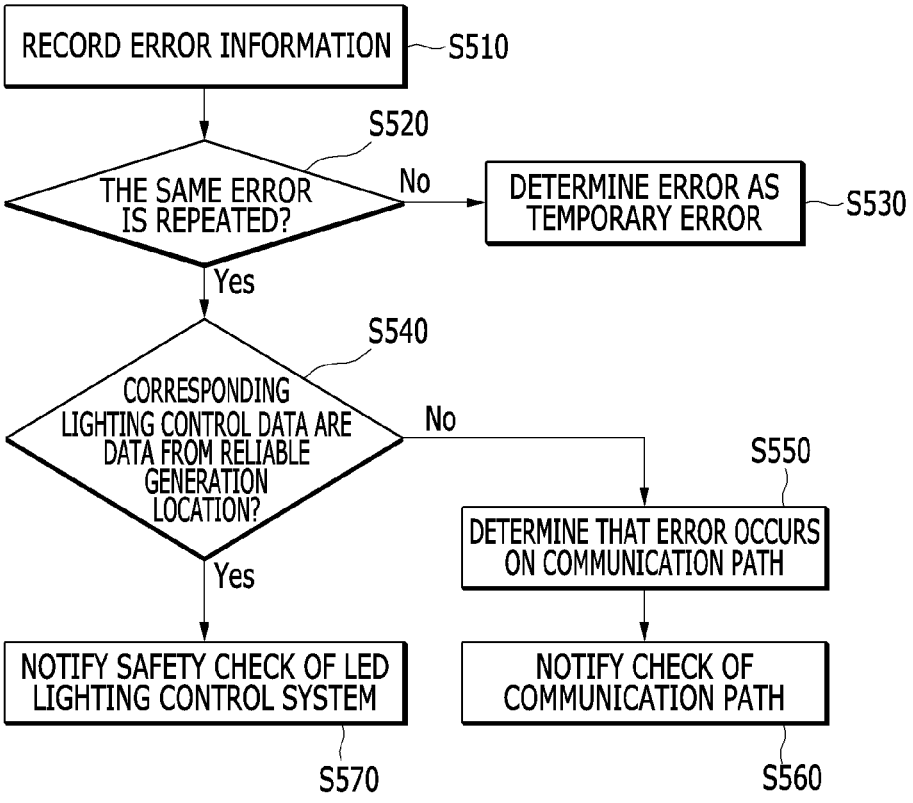
FIG. 5 is a flowchart showing a method of processing an error according to an embodiment of the present invention.

FIG. 5 is a flowchart showing a method of processing an error according to an embodiment of the present invention.

Referring to FIG. 5, the error processor 350 of the LED lighting control device 220 records information of a source of an error, a generating time of the error, and/or error contents (S510), and the error processor 350 determines whether the same error is repeated by comparing previously recorded information and present information (S520). If the same error is not repeated, the error processor 350 determines the error as a temporary error and terminates an error processing procedure (S530). If the same error is repeated, the error processor 350 determines whether the lighting control data are originated from a reliable source (S540). If the lighting control data are originated from a reliable source, the error processor 350 determines that the error occurs on a communication path (S550). In order to notify a check of a communication path that is connected to an input interface of the LED lighting 110, the error processor 350 represents an abnormal state by blinking the LED lighting with a specific color (S560). If the lighting control data are originated from a wrong source, the error processor 350 notifies a safety check of the LED lighting control system 100 (S570). In this case, the error processor 350 may notify an abnormal state by blinking the LED lighting with a color different from the color of the step S560 or in a cycle different from the cycle of the step S560.

Next, a confirmation code according to an embodiment of the present invention will be described in detail with reference to FIGS. 6 to 8.

Figure 6:
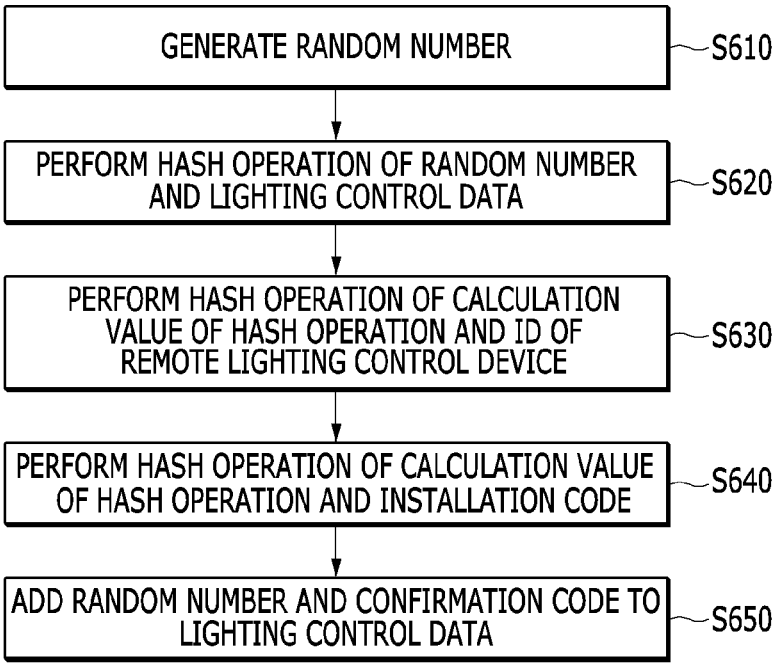
FIGS. 6 and 7 are flowcharts showing a method of generating a confirmation code according to an embodiment of the present invention.
Figure 7:
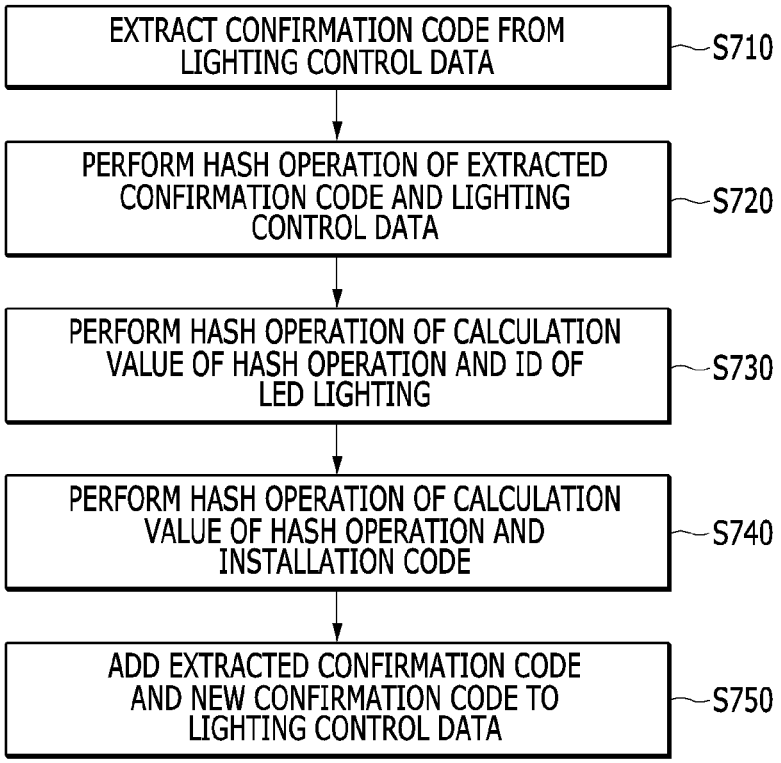

FIGS. 6 and 7 are flowcharts showing a method of generating a confirmation code according to an embodiment of the present invention; FIG. 6 illustrates a method of generating a confirmation code in the remote lighting control device 130; and FIG. 7 illustrates a method of generating a confirmation code in the LED lighting 110.

Referring to FIG. 6, the remote lighting control device 120 generates a random number for preventing reuse of a confirmation code (S610), and the remote lighting control device 120 performs a hash operation of the random number and lighting control data of the LED lighting 110 that first receives lighting control data (S620). The remote lighting control device 120 performs a hash operation of a calculation value of the hash operation and an ID of the remote lighting control device (S630), and generates a confirmation code by performing a hash operation of the calculation value of the hash operation of the step S630 and the installation code (S640). The installation code may be a code that is given by a manager when the LED lighting control system 100 is initially installed.

Next, the remote lighting control device 120 inserts a random number and a confirmation code to the lighting control data (S650). In this case, the remote lighting control device 120 positions the random number at the first portion of a lighting control data frame and positions the confirmation code at the last portion of the lighting control data frame and thus can use the confirmation code in a confirmation code check procedure of the first LED lighting 110. The lighting control data that are generated in the remote lighting control device 120 are lighting control data to be received by the first LED lighting 110 on the LED lighting network 130.

Referring to FIG. 7, the LED lighting 110 extracts the confirmation code from the lighting control data (S710), and performs a hash operation of the extracted confirmation code and the lighting control data of an LED lighting (i.e., the next LED lighting) 110 for receiving the lighting control signal from the present LED lighting 110 (S720). The LED lighting 110 performs a hash operation of a calculation value of the hash operation and an ID of the present LED lighting 110 (S730), and generates a new confirmation code by performing a hash operation of the calculation value of the hash operation of step S730 and the installation code (S740). The installation code may be a code that is given by a manager when the LED lighting control system 100 is initially installed.

Next, the LED lighting 110 inserts the confirmation code that is extracted from existing lighting control data and the new confirmation code to the lighting control data (S750) and transfers the lighting control data to the next LED lighting 110. In this case, the LED lighting 110 positions the extracted confirmation code at the first portion of the lighting control data frame and positions the new confirmation code at the last portion of the lighting control data frame, thereby using the new confirmation code in a confirmation code check procedure of the next LED lighting.

Figure 8:
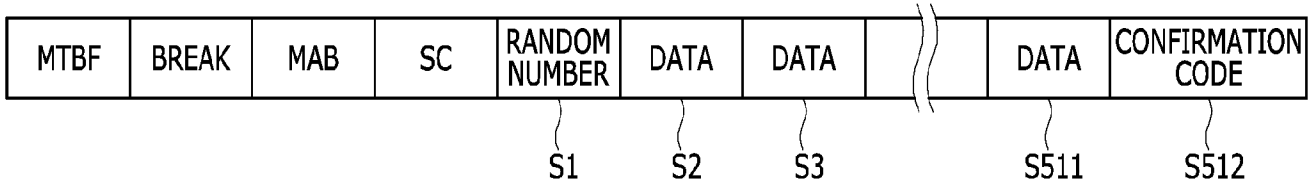
FIG. 8 is a diagram showing a frame of a lighting control signal according to an embodiment of the present invention.

FIG. 8 is a diagram showing a frame of a lighting control signal according to an embodiment of the present invention.

Referring to FIG. 8, the lighting control signal follows a DMX512 protocol and includes a lighting control data frame including a plurality of slots S1 to S512. The plurality of slots S1 to S512 may be 512 slots, each of which has 8 bits.

In order to notify the lighting control signal, the lighting control signal is maintained to a low level for a predetermined period BREAK and then has a high level as a mark after break (MAB) for representing a type of the BREAK. Subsequently, the lighting control signal has a start code (SC) for notifying a start of actual data. Thereafter, the lighting control signal has a lighting control data frame including the plurality of slots S1 to S512. The first slot S1 of the slots S1 to S512 includes the random number that is described in FIG. 6 or the extracted confirmation code that is described in FIG. 7, and the last slot S512 includes the new confirmation code that is described in FIGS. 6 and 7. At least some slots of the remaining slots S2 to S511 include lighting control data.

A mark time between frames (MTBF) exists between lighting control signal frames.

Therefore, the LED lighting 110 that receives a lighting control signal can determine whether to process the lighting control data by verifying the confirmation code that is positioned at the last slot S512.

According to an embodiment of the present invention, when performing a remote lighting control with a network, lighting control data can be verified, thereby preventing wrong light emission and thus light pollution can be prevented. Further, when lighting control data have a problem, by displaying an abnormal state, a lighting control system can be quickly recovered.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A device for controlling an LED lighting in an LED lighting control system including a plurality of LED lightings which are connected via a network, the device comprising:

a lighting data receiver configured to receive a first lighting control signal and extract first lighting control data for the LED lighting from the first lighting control signal including a confirmation code;

a verifier configured to verify the first lighting control data based on the confirmation code;

an error processor configured to record error information when the verifier fails to verify the first lighting control data;

a driving signal processor configured to convert the first lighting control data to a driving signal when the verifier succeeds to verify the first lighting control data; and an LED driver configured to control lighting of an LED light source based on the driving signal.

2. The device of claim 1, wherein the error processor compares the error information with previous error information to determine whether the same error is repeated, and determines reliability of a source of the first lighting control data when the same error is repeated.

3. The device of claim 2, wherein the error processor blinks the LED light source with a first color in a first cycle when the source of the first lighting control data has reliability, and blinks the LED light source with a second color different from the first color or in a second cycle different from the first cycle when the source of the first lighting control data does not have reliability.

4. The device of claim 1, wherein the lighting data receiver receives the first lighting control signal from a previous LED lighting among the plurality of LED lightings.

5. The device of claim 4, wherein the confirmation code is generated by the previous LED lighting, and the confirmation code is generated based on information including the first lighting control data and a confirmation code which the previous LED lighting extracts from a received lighting control signal.

6. The device of claim 1, wherein the lighting data receiver receives the lighting control signal from a remote lighting control device that controls the plurality of LED lightings via the network.

7. The device of claim 6, wherein the confirmation code is generated by the remote lighting control device, and the confirmation code is generated based on information including the first lighting control data and a random number that is generated in the remote lighting control device.

8. The device of claim 1, further comprising a lighting data transmitter configured to transmit a second lighting control signal to a next LED lighting among the plurality of LED lightings when the verifier succeeds to verify the first lighting control data.

9. The device of claim 8, wherein the lighting data transmitter generates a new confirmation code based on confirmation code information including the confirmation code and second lighting control data to be transferred to the next LED lighting, and generates the second lighting control signal by adding the new confirmation code to the second lighting control data.

10. The device of claim 9, wherein the confirmation code information further includes an identifier and an installation code of the LED lighting, and the lighting data transmitter generates a first hash operation value by a hash operation of the confirmation code and the second lighting control data, generates a second hash operation value by a hash operation of the first hash operation value and the identifier, and generates the new confirmation code by a hash operation of the second hash operation value and the installation code.

11. The device of claim 9, wherein the lighting data transmitter adds the new confirmation code to a last slot of a plurality of slots that are included in the second lighting control signal.

* * * * *